US005797832A

United States Patent [19]

Ong et al.

[11] Patent Number: 5,797,832

[45] Date of Patent: Aug. 25, 1998

[54] APPARATUS AND METHOD FOR FORMING LIGHTWEIGHT PALLETS

[75] Inventors: Alex Ong, North Carlton; Ross Chiodo; John Mammoliti, both of Reservoir, all of Australia

[73] Assignee: Visy Paper PTY Ltd, Reservoir, Australia

[21] Appl. No.: 485,683

[22] Filed: Jun. 7, 1995

Related U.S. Application Data

[63] Continuation-in-part of Ser. No. 969,041, Oct. 30, 1992, Pat. No. 5,448,956, which is a continuation-in-part of Ser. No. 838,518, Feb. 19, 1992, abandoned.

[30] Foreign Application Priority Data

Feb. 22, 1991 [AU] Australia ..... PK 4761

[51] Int. Cl.[6] ..... B31F 1/10

[52] U.S. Cl. ..... 493/462; 493/454; 493/964; 108/51.3

[58] Field of Search ..... 493/144, 151, 493/155, 162, 163, 175, 246, 247, 250–253, 264, 266, 295, 454, 462, 964, 164, 395, 460, 461, 352; 108/51.3; 156/184, 189, 190, 191, 446, 450

[56] References Cited

U.S. PATENT DOCUMENTS

| | | | |
|---|---|---|---|
| 484,041 | 10/1892 | Murray et al. | 493/175 |
| 1,747,367 | 2/1930 | Hohl et al. | 493/462 |
| 2,016,052 | 10/1935 | Roeder | 164/91 |
| 2,197,782 | 4/1940 | Barbieri | 493/155 |
| 2,691,500 | 10/1954 | Baumann | 248/120 |
| 2,732,063 | 1/1956 | Dedek et al. | 493/462 |
| 2,856,826 | 10/1958 | Norquist et al. | 493/964 |
| 2,970,797 | 2/1961 | Desbois | 248/120 |
| 3,196,759 | 7/1965 | Palmer et al. | 493/139 |
| 3,199,670 | 8/1965 | Palmer | 229/162 |
| 3,240,611 | 3/1966 | Williams | 493/61 |
| 3,732,790 | 5/1973 | Miyake et al. | 156/207 |
| 3,919,925 | 11/1975 | Hayama | 493/295 |
| 4,398,904 | 8/1983 | Fagerberg | 493/155 |
| 4,441,948 | 4/1984 | Gillard et al. | 493/295 |
| 4,551,124 | 11/1985 | Mowry | 493/132 |
| 4,792,325 | 12/1988 | Schmidtke | 493/964 |
| 5,184,558 | 2/1993 | Wozniacki | 493/964 |
| 5,336,042 | 8/1994 | Winski et al. | 493/964 |
| 5,372,570 | 12/1994 | Schmidtke et al. | 493/964 |
| 5,448,956 | 9/1995 | Ong et al. | 108/51.3 |
| 5,569,148 | 10/1996 | LaFreniere et al. | 493/964 |

*Primary Examiner*—Michael J. Cardone
*Assistant Examiner*—Darren Ark
*Attorney, Agent, or Firm*—Foley & Lardner

[57] ABSTRACT

An apparatus for forming lightweight pallets from tightly wound single-face corrugated board includes a support for a reel of corrugated board, tensioning apparatus for applying a tensioning force to the corrugated board, slitting and advancing apparatus for slitting the board into narrow strips, an adhesive applicator for applying adhesive to the corrugated medium of said board, a winding reel including a central retractable mandrel about which the strips are initially wound, and further shaped mandrels which are selectively introduced into the winding reel to block the winding of corrugated board in predetermined regions to create shaped openings in the lightweight pallet, and severing apparatus for severing the strips when the winding operation is completed.

7 Claims, 9 Drawing Sheets

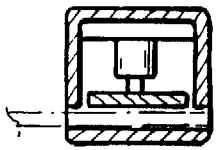
Fig. 8.
Fig. 7.
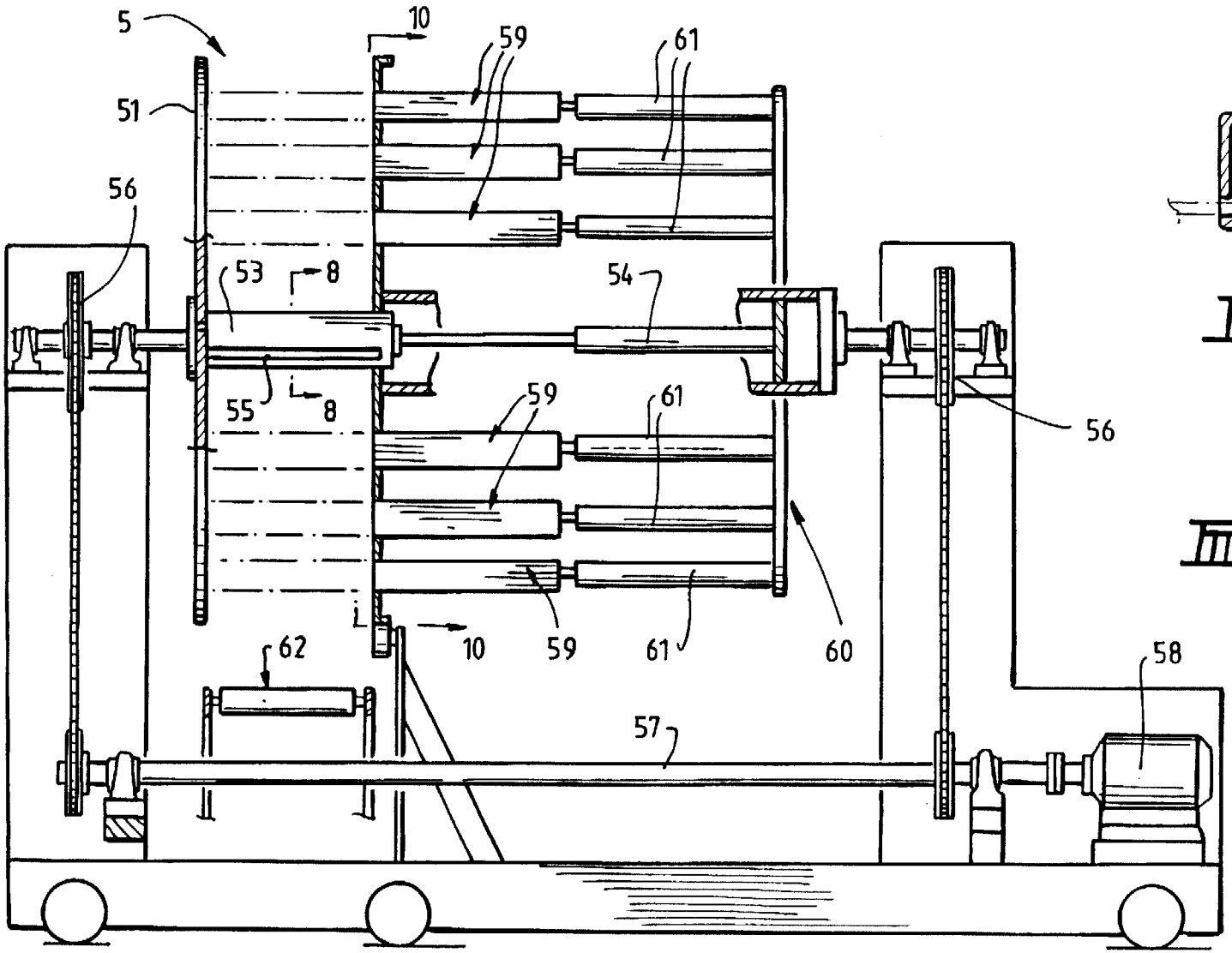

APPARATUS AND METHOD FOR FORMING LIGHTWEIGHT PALLETS

REFERENCE TO RELATED APPLICATION

This application is a Continuation-in-Part of U.S. patent application Ser. No. 07/969041 filed 30 Oct. 1992, U.S. Pat. No. 5,448,956, which was a Continuation-in-Part of U.S. patent application Ser. No. 07/838518 filed 19 Feb. 1992 abandoned.

FIELD OF THE INVENTION

This invention relates to an apparatus and method for forming lightweight pallets and other structures formed from tightly wound strips of corrugated board or paper.

BACKGROUND OF THE INVENTION

In our International Patent Application No. PCT/AU94/00008, and in the above U.S. Patent Application, the contents of which are incorporated by cross-reference, we have described a lightweight pallet formed from tightly wound single-face corrugated board. The cost of manufacturing such pallets is dependent on the manufacturing process used since manual winding of the pallet, while possible, is clearly cost prohibitive.

SUMMARY OF THE INVENTION AND OBJECT

It is an object of the present invention to provide an apparatus for winding strips of corrugated board or paper into a shaped structure, such as a lightweight pallet of the type described in the Applications identified above.

The invention provides an apparatus for forming structures of tightly wound paper, cardboard or corrugated board, comprising means for supporting a roll of paper, cardboard or corrugated board, means for tensioning said paper, cardboard or corrugated board as it leaves said roll, means for advancing said paper, cardboard or corrugated board from said roll to a forming reel, means for applying adhesive to at least one side of said paper, cardboard or corrugated board, means for attaching the free end of said paper, cardboard or corrugated board to said reel to enable the paper, cardboard or corrugated board to be wound onto the reel, mandrel means associated with said reel for introducing a shape into the wound paper, cardboard or corrugated board, and means for severing said paper, cardboard or corrugated board when the wound structure is complete.

In one form of the invention, a slitting means is provided ahead of the advancing means to slit the paper, cardboard or corrugated board into multiple strips, with the strips being fed in unison to the advancing means. Where the structure is to be formed from single-face corrugated board, the adhesive applying means is positioned to apply adhesive to the corrugated side of the strips so that adjacent layers of the strips are adhesively secured together as the strips are tightly wound onto the forming reel.

Where the structure to be formed is a pallet of the type described in FIGS. 7 to 9 of the above-identified Patent Applications, a multiplicity of mandrel means are provided to define the shaped openings in the pallet structure, and control means are provided to introduce the mandrels between the strips and the forming reel in a timed manner as the strips are wound onto the reel to thereby form a pallet structure having the requisite shaped openings.

BRIEF DESCRIPTION OF THE DRAWINGS

FIG. 7 is an end elevation of a third part of the apparatus of FIG. 3 taken along the line 7—7 in FIG. 3;

FIG. 8 is a detailed sectional elevation of the clamping strip shown in FIG. 7 taken along the line 8—8 in FIG. 7;

DESCRIPTION OF PREFERRED EMBODIMENT

Figure 1:
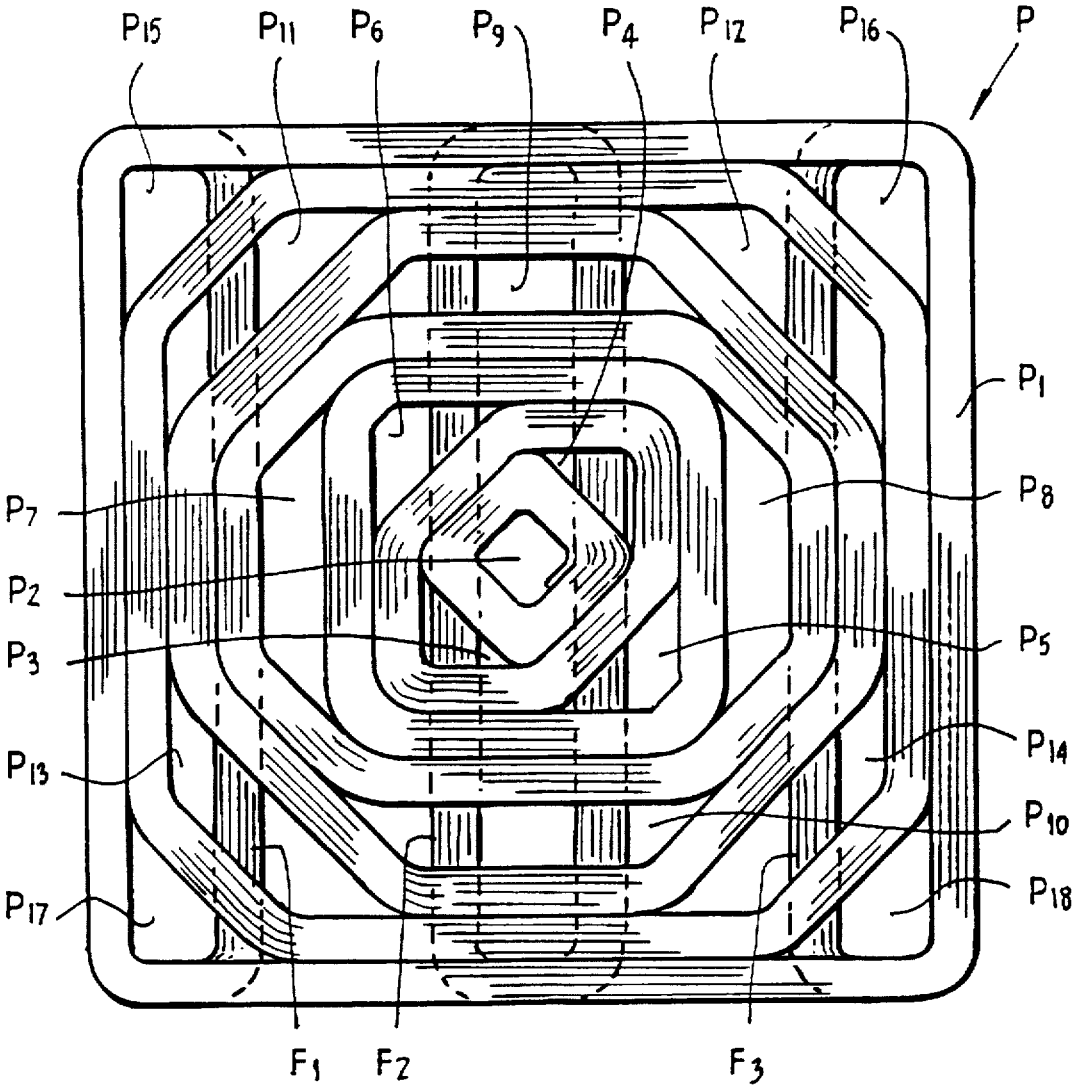
FIG. 1 is a plan view of a pallet formed by an apparatus and method embodying the invention.
Figure 2:
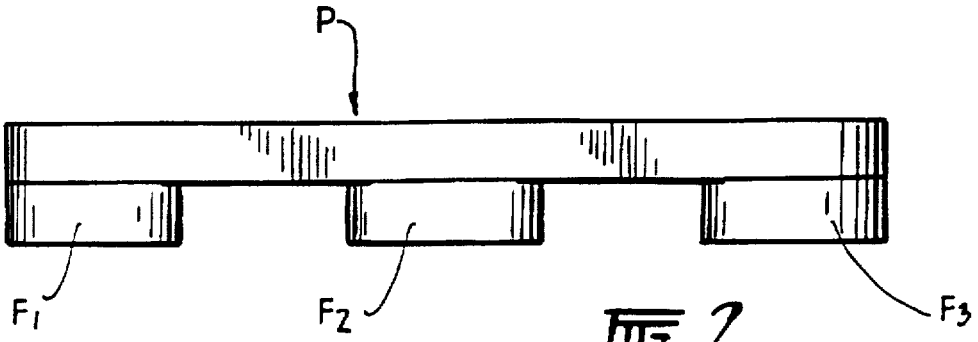
FIG. 2 is a side elevation of the pallet of FIG. 1.

Referring firstly to FIGS. 1 and 2 of the drawings, a presently preferred configuration for the pallet formed by the apparatus embodying the invention is shown. The pallet P is formed from a continuous strip of single-face corrugated board B wound in multiple layers to define a continuous supporting element $P_1$ defining a central square opening $P_2$, which may alternatively be round, a pair of opposed generally triangular openings $P_3$, $P_4$, a pair of opposed truncated triangular openings $P_5$, $P_6$ at 90° to the triangular openings $P_3$, $P_4$, a further pair of larger truncated triangular openings $P_7$, $P_8$, located at 45° to the preceding pair, a further pair of slightly larger truncated triangular openings $P_9$, $P_{10}$ at 90° to the preceding pair, two further opposed pairs of larger truncated triangular openings $P_{11}$, $P_{12}$, $P_{13}$, $P_{14}$, at 45° to each of the preceding openings $P_9$, $P_{10}$, and triangular openings $P_{15}$, $P_{16}$, $P_{17}$ and $P_{18}$ at the corners of the pallet defined by the square peripheral element $P_1$ of wound single-face corrugated board B.

The triangular and truncated triangular openings in the pallet P are present for the purpose of generating a final pallet shape which is substantially square, and for providing cross beam members which are at a 45° angle to the principal direction of support by the lifting forks between the feet described below. These beam members provide the resistance to bending of the pallet when the pallet is lifted by forks carrying a load. The arrangement of openings reduces the amount of corrugated board B used to form the pallet while ensuring that the resistance to bending of the pallet will be satisfactorily met by the beam members.

The pallet P is provided with three elongate generally rectangular feet $F_1$, $F_2$ and $F_3$, which comprise wound single-face corrugated board B defining an open rectangular loop of the configuration shown in FIGS. 1 and 2. If desired, the edges of the feet which are to contact a support surface may be treated to prevent damage by moisture. For example, the edges may be dipped in water-proofing wax or may have thin particle board laminated to their lowermost faces. The provision of separate feet which are adhesively secured to the lower face of the pallet is a preferred method of providing fork access for the pallet since the provision of slots in the pallet structure may undesirably weaken the structure.

Figure 3:
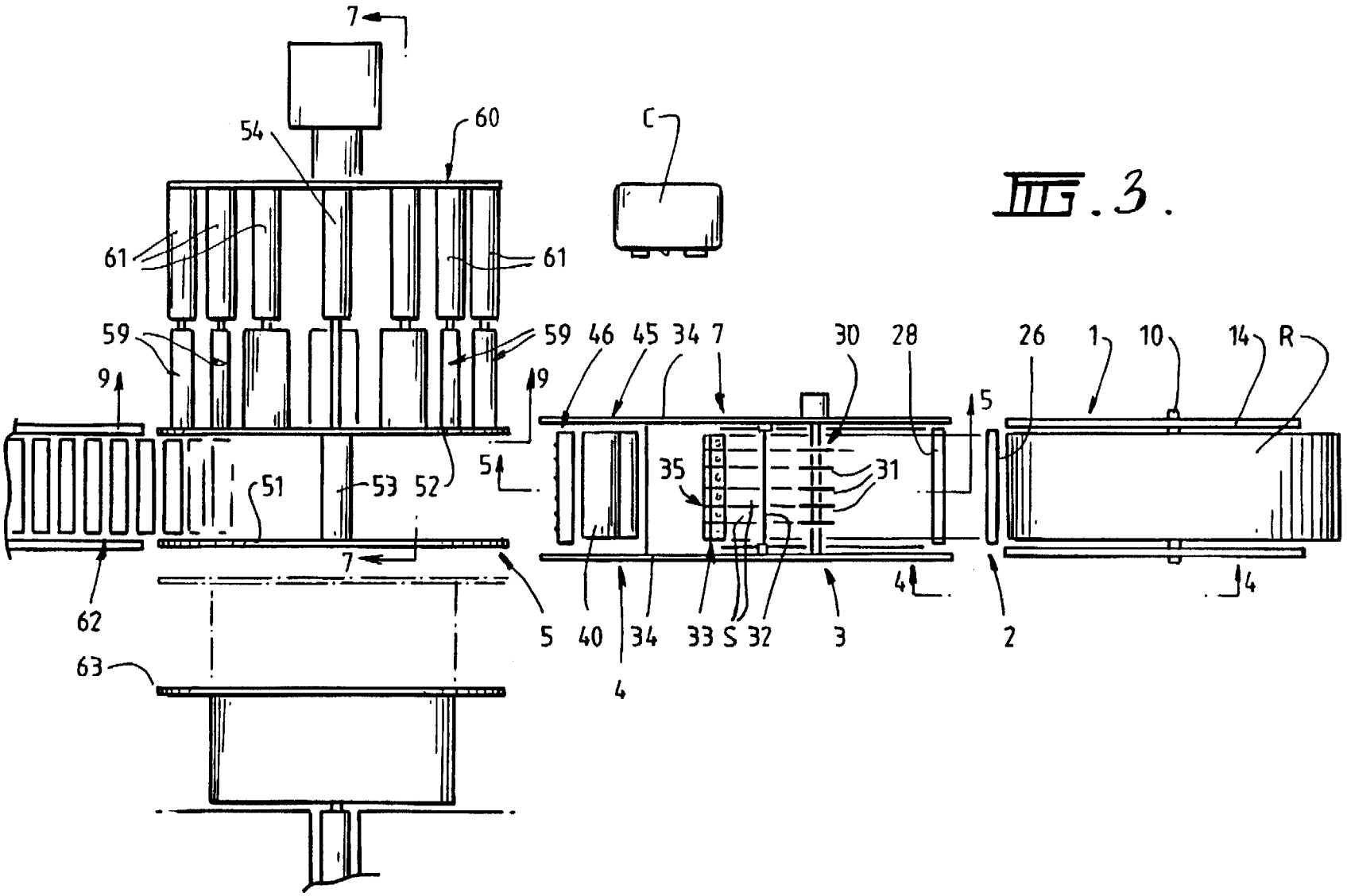
FIG. 3 is a schematic plan view of a pallet forming apparatus embodying the invention and capable of performing the method of the invention.

Referring now to FIGS. 3 to 7 of the drawings, and in particular FIG. 3, the apparatus embodying the invention comprises means 1 for supporting a roll R of single-face corrugated board B, tensioning means 2 for tensioning the corrugated board B as it is paid out from the roll R, slitting and advancing means 3 for converting the corrugated board B into a multiplicity of parallel narrow strips S, adhesive applying means 4 positioned to apply adhesive to the corrugated side of the strips S, a forming reel 5 to which the strips are secured to facilitate winding of the strips into shaped structures, reciprocating mandrel means 53, 59 for defining shaped openings in the structure as the strips S are wound on the reel 5, and severing means 7 for initially trimming the leading edge of the strips S and for severing the strips S when the winding operation is completed.

Figure 4:
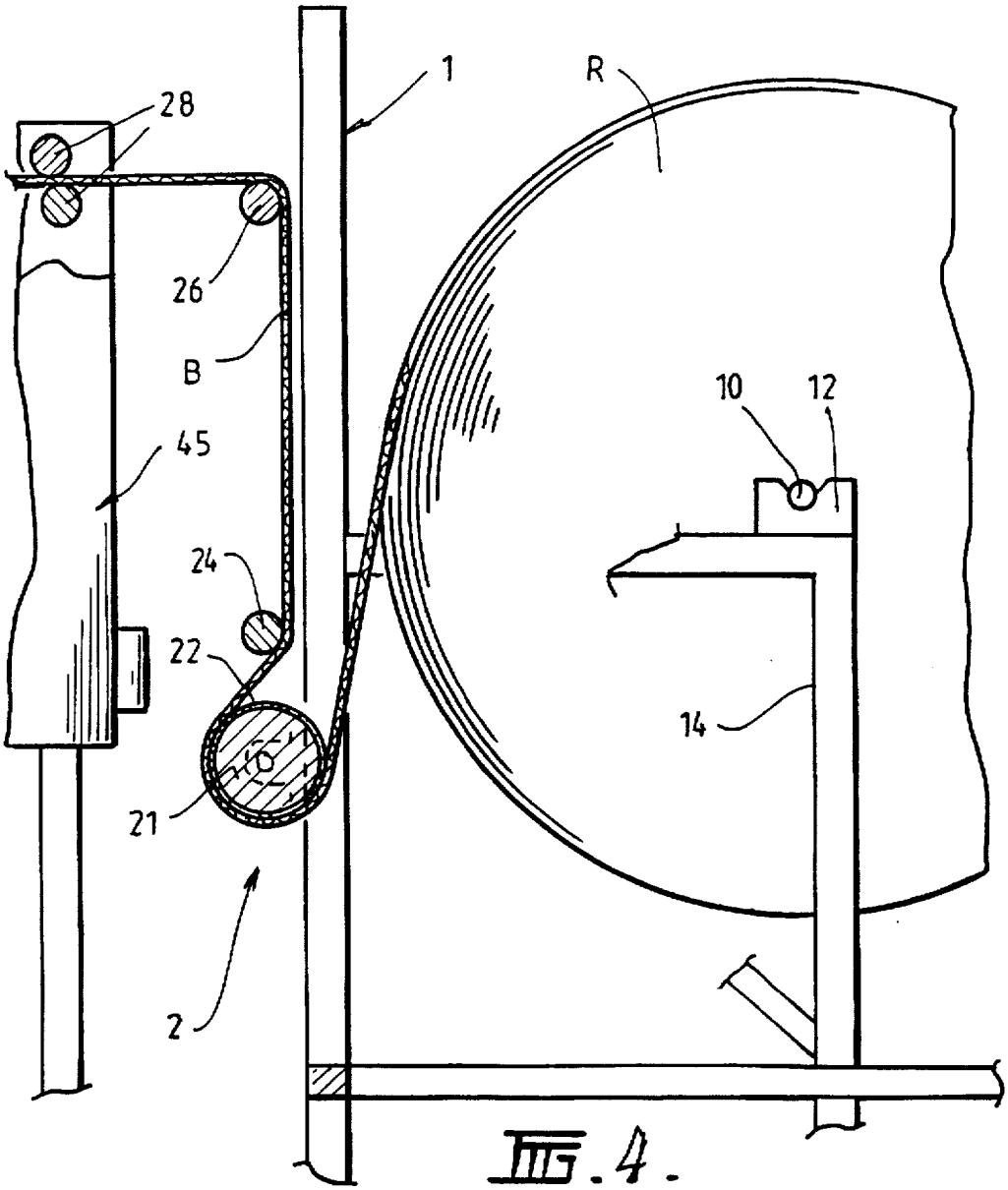
FIG. 4 is a fragmentary elevation of part of the apparatus of FIG. 3 taken along the line 4—4 in FIG. 3.

As shown most clearly in FIGS. 3 and 4, the roll supporting means I comprises a shaft 10 which passes through the roll R and engages at either end, supporting cradles 12, on a frame 14, so that the roll R is freely rotatably supported.

The tensioning means 2 comprises a driven roller 21 having a friction surface 22 about which the board B passes, an idler roller 24, and a support roller 26, which are rotatably mounted on the frame 14, the roller 26 being positioned to guide the board B horizontally between guide rollers 28 towards the slitting and advancing means 3. The rollers 21, 24 and 26 are suitably rotatably mounted on the frame 14 as shown.

The slitting and advancing means 3 comprises a driven slitting roller 30 having a multiplicity of spaced radially extending parallel slitting blades 31 which, in the present embodiment, are spaced to slit the corrugated board B into six narrow strips S of equal width. A trimming blade 32 is positioned adjacent the slitting roller 30 and operates to initially trim the board B along a line perpendicular to the line of slitting before the advancing means is operated, and for severing the strips S when the winding operation has been completed.

Figure 6:
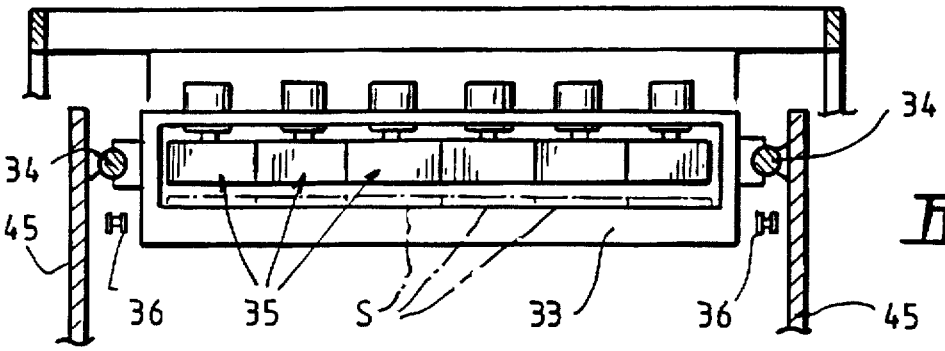
FIG. 6 is a sectional end elevation taken along the line 6—6 in FIG. 5.
Figure 5:
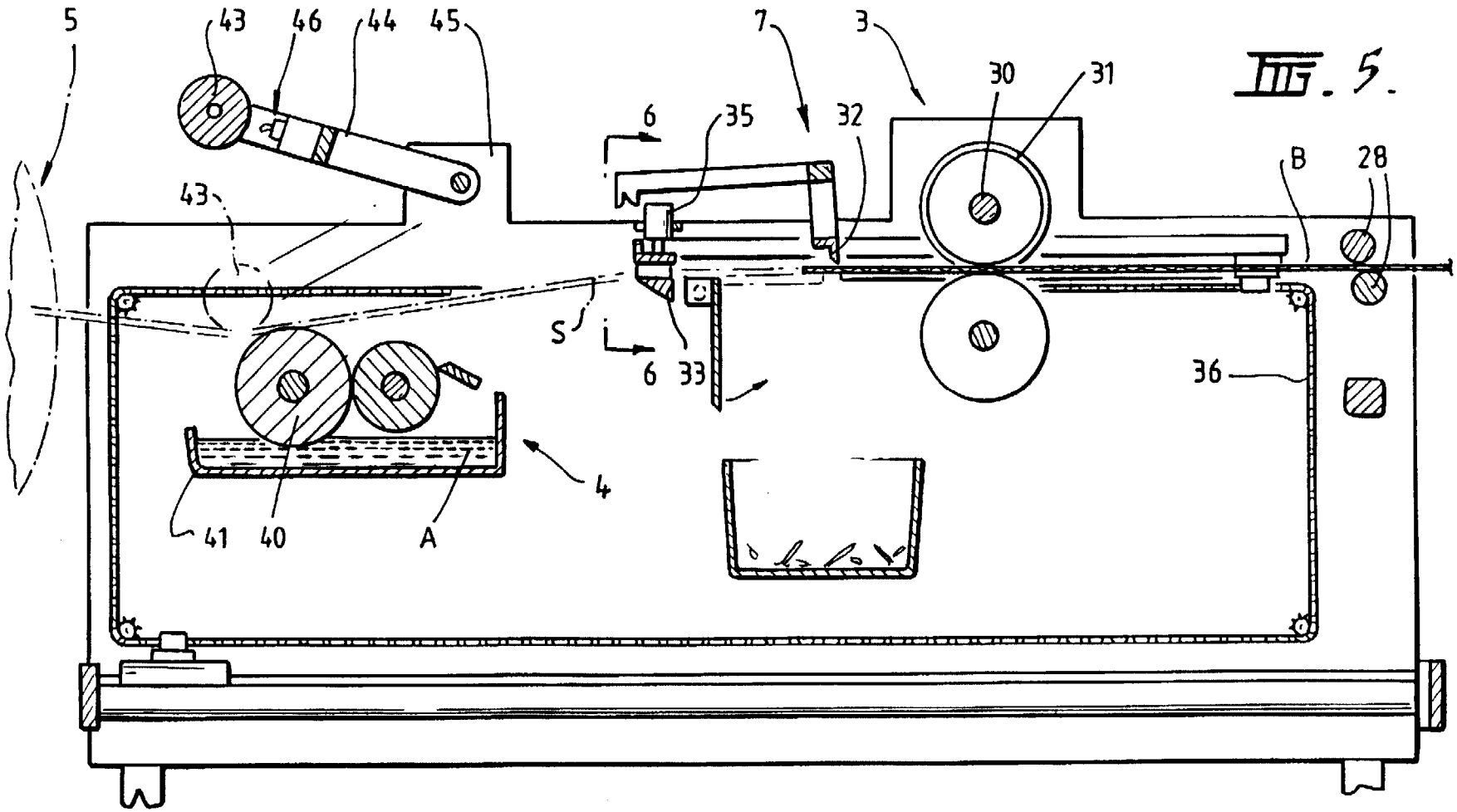
FIG. 5 is a fragmentary elevation of a second part of the apparatus of FIG. 3 taken along the line 5—5 in FIG. 3.
Figure 9A:
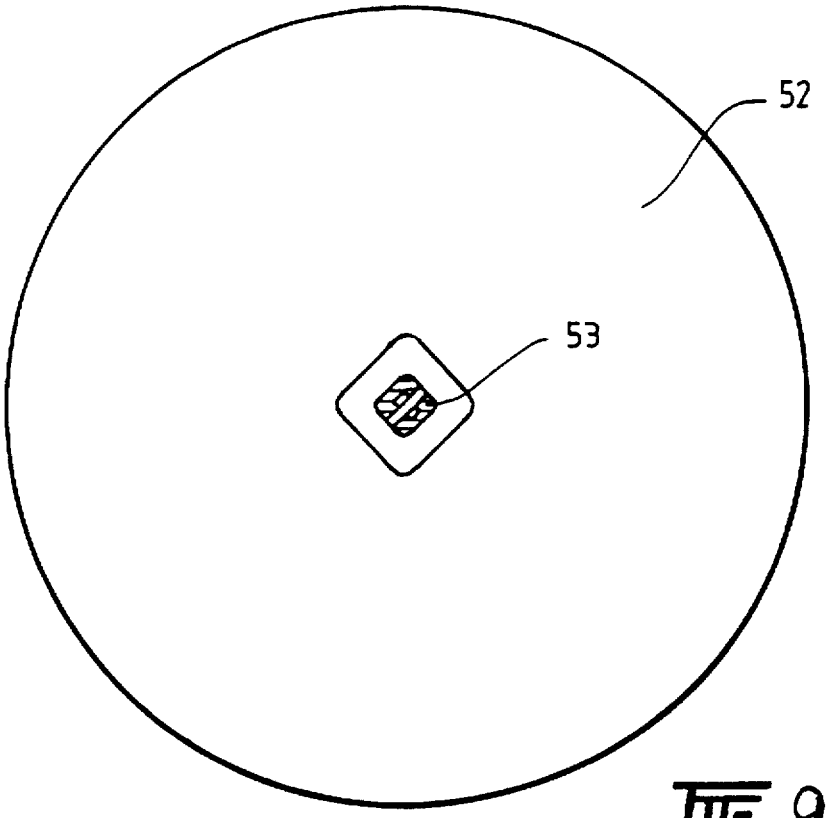
FIGS. 9*a* to 9*g* are schematic sectional end elevations taken along the line 9—9 in FIG. 3 showing the use of the mandrels 59 to form the pallets P.
Figure 9B:
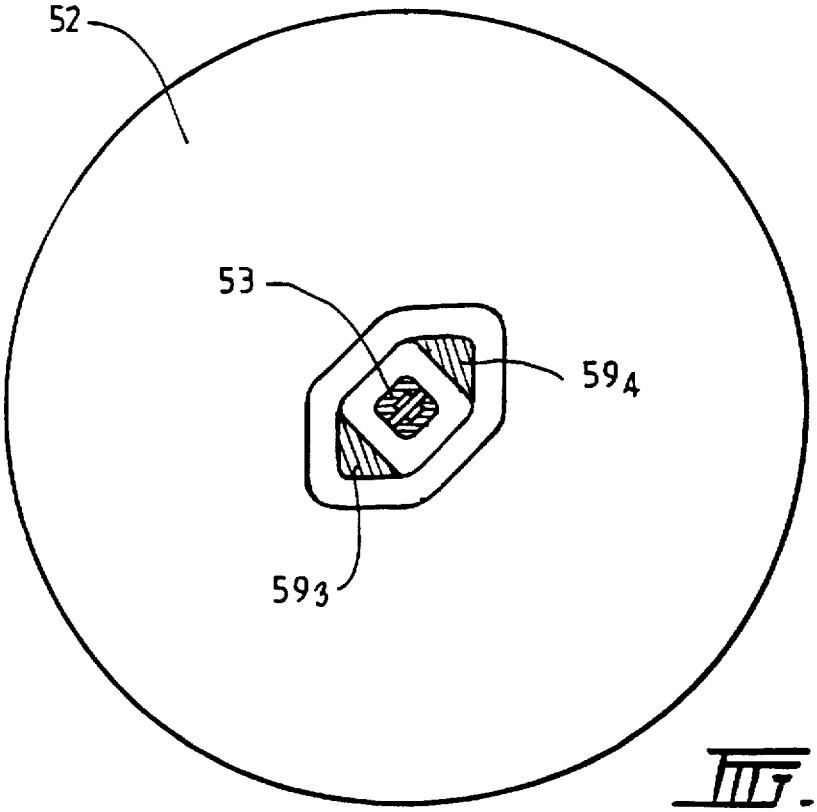
Figure 9C:
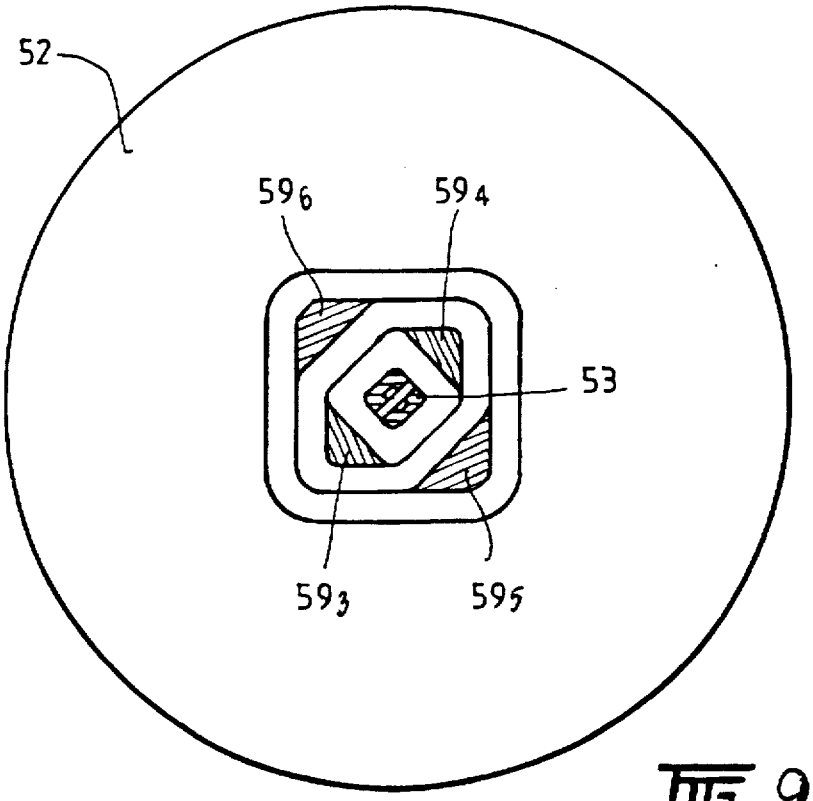
Figure 9D:
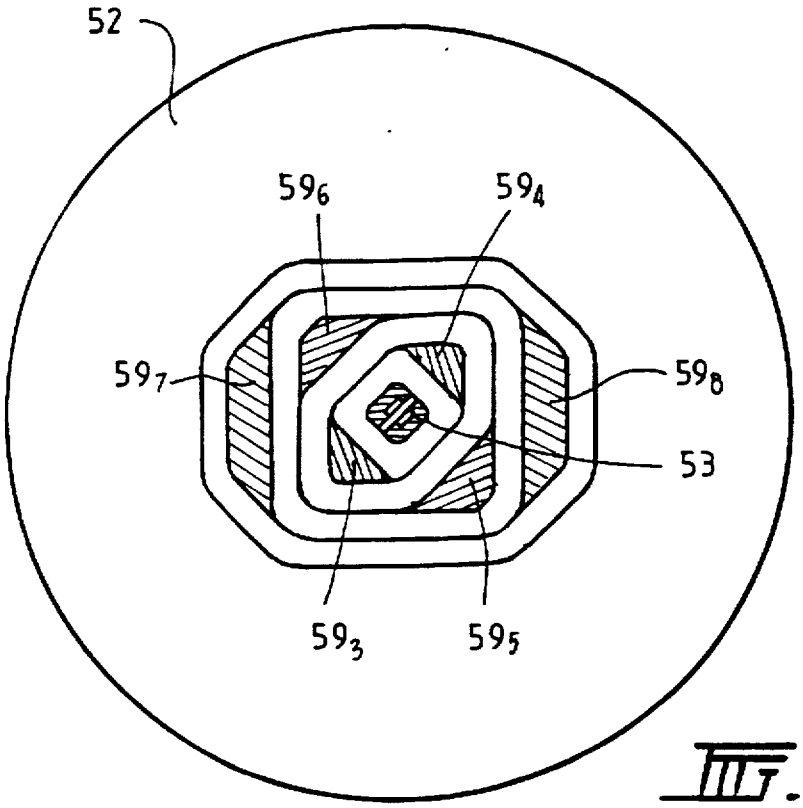
Figure 9E:
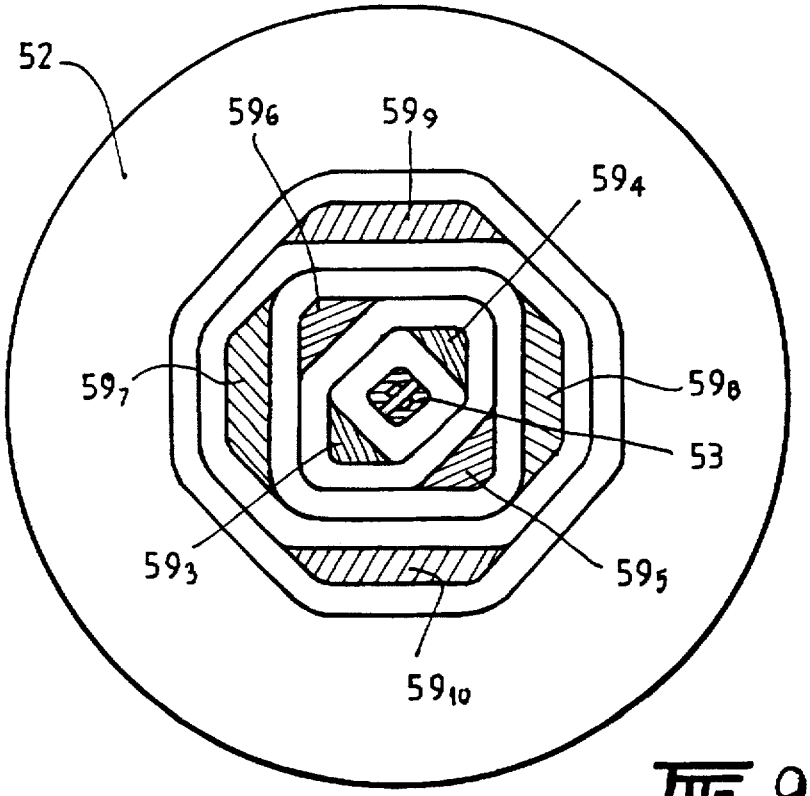
Figure 9F:
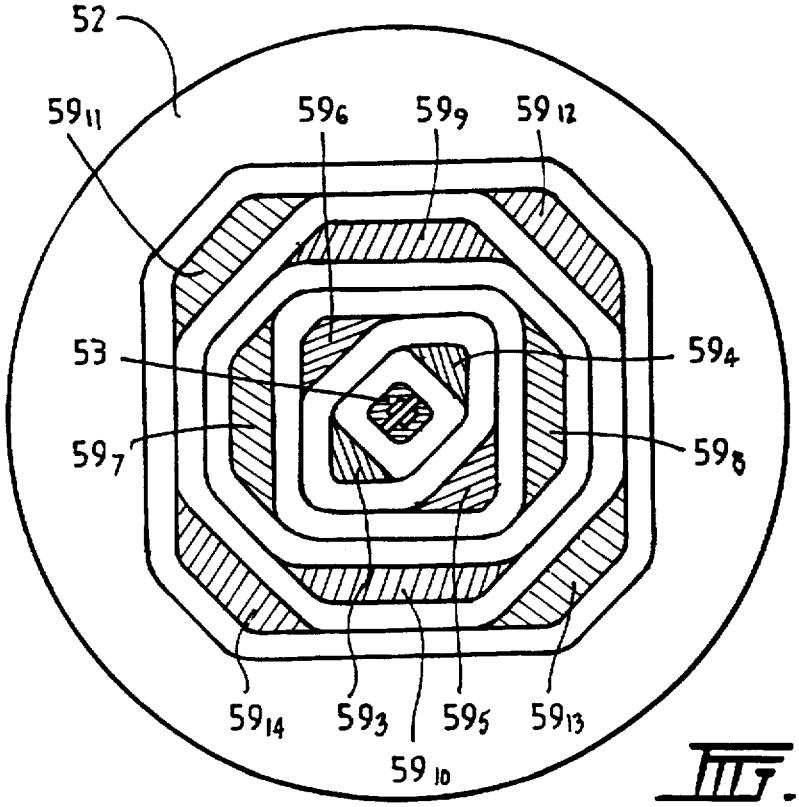
Figure 9:
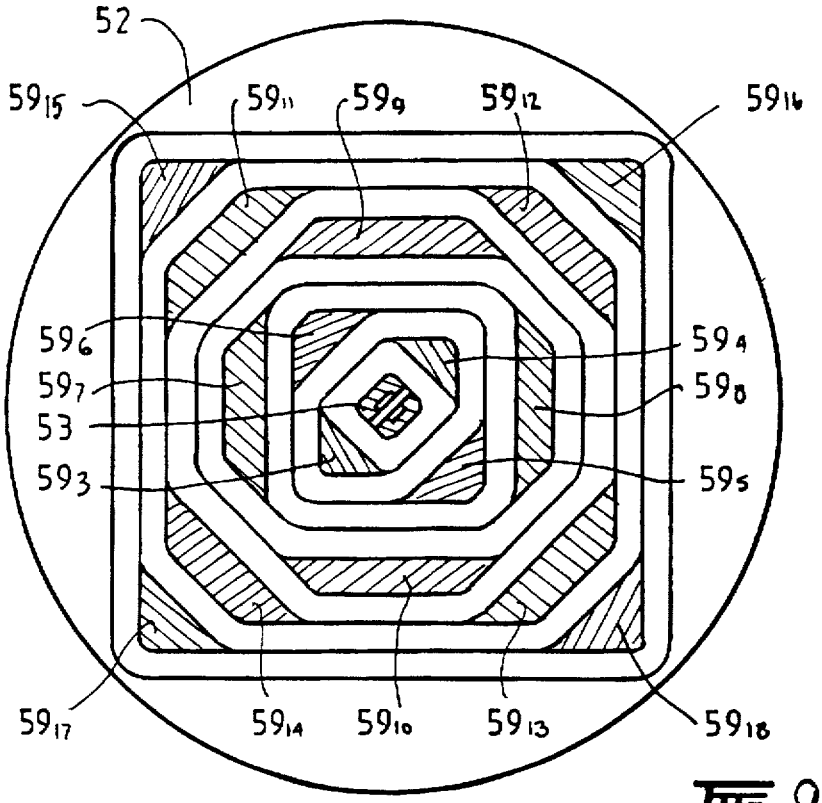

Referring to FIGS. 5 and 6, the advancing means comprises a cross-bar 33 mounted for reciprocating movement on guide rods 34 mounted at either side of the apparatus, the cross-bar 33 supporting six pneumatic clamps 35 which operate to clamp each strip S to the cross-bar 33 which is driven along the guide rods 34 by a chain drive mechanism 35 to facilitate advancing of the strips S from their starting position to an operative position on the winding reel 5. The strips S are secured to the winding reel 5, in a manner to be described further below, and the advancing means 3 is allowed to return to its rest position prior to the winding operation commencing.

Referring to FIG. 5, the adhesive applicator 4 comprises a driven applicator roller 40 arranged over a trough 41 containing adhesive A so that the surface of the roller 40 contacts the adhesive in the trough 41. The strips S are held in contact with the applicator roller 40 by a roller 43 on arms 44 pivoted to the frame 45 of the machine and the required quantity of adhesive is transferred to the corrugated side of the strips as the strips are wound onto the reel 5 in the manner to be described below. A hot melt adhesive applicator 46 is mounted on the frame 44 over the strips S and operates to apply hot melt adhesive to the upper surface of the strips S as the winding operation nears completion so that the outermost layers of the strips S are more positively adhesively secured to prevent unwinding.

Referring to FIGS. 7 and 8, the winding reel 5 comprises parallel flanges 51, 52, between which the strips are wound as described further below. A central square mandrel 53 passes through a central opening in the flange 52 under the control of a pneumatic cylinder 54, and includes a clamping strip 55 (FIG. 8) under which the leading edges of the strips S are clamped at the commencement of the winding operation. The flange 51 is rotatably driven by a chain drive mechanism 56 via a drive shaft 57 driven by a motor 58, the speed of which is controlled by a central programmed controller C.

Figure 10:
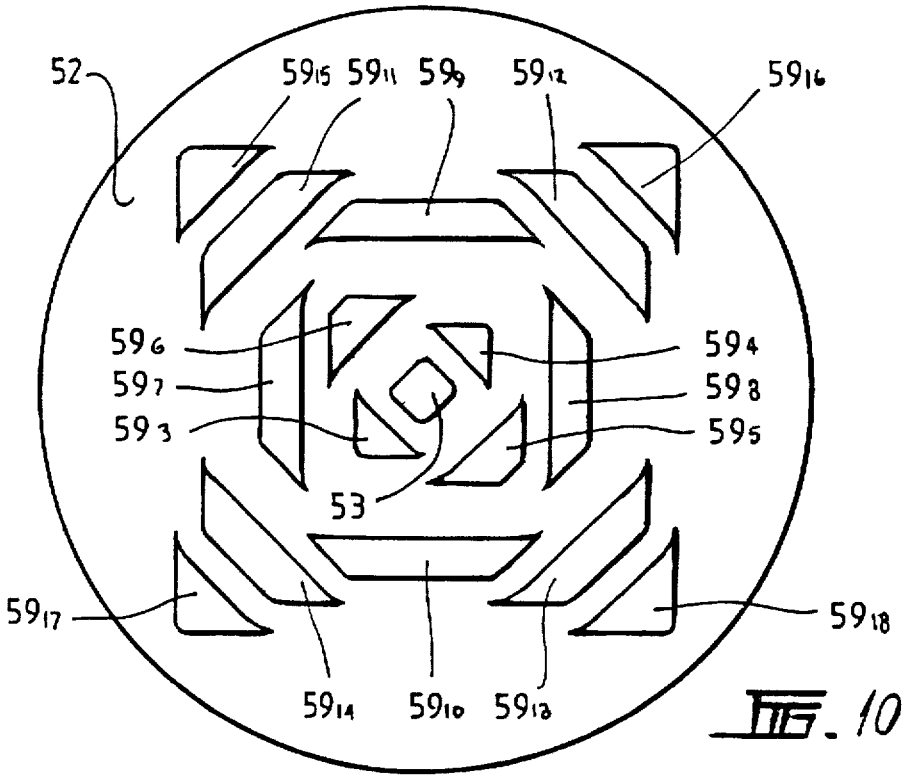
FIG. 10 is an end elevation taken along the line 10—10 in FIG. 7 showing the positioning of the mandrels 59 in the winding reel flange 52.

The flange 52 also carries a further series of pneumatically operated mandrels $\mathbf{59}_3$ to $\mathbf{59}_{18}$ (corresponding to openings $P_3$ to $P_{18}$) arranged at spaced positions from the central mandrel 53 on a supporting frame 60 so as to define the openings in the pallet described in greater detail above. Each mandrel $\mathbf{59}_3$ to $\mathbf{59}_{18}$, is advanced through a shaped opening (FIG. 10) in the flange 52 into the space between the flanges 51 and 52 by corresponding pneumatic cylinders $\mathbf{61}_3$ to $\mathbf{61}_{18}$ under the control of the controller C which ensures that the mandrels $\mathbf{59}_3$ to $\mathbf{59}_{18}$, are advanced at the appropriate time during the winding operation.

The apparatus embodying the invention operates in an essentially automatic manner under the control of the central controller C and is able to form six lightweight pallets in approximately 5.5 minutes. It is envisaged that as many as 10 strips S could be cut from a wider roll R of board B thereby further increasing the output of the apparatus.

In use, a roll R of single-face corrugated board is mounted on the shaft 10 which is then engaged with the cradles 12 for free rotation with respect to the frame 14. A length of board B is unwound and fed around the tensioning roller 22, behind the idler roller 24 and over the support roller 26 and between guide rollers 28 until the leading end of the board B reaches the slitting roller 30. The slitting roller 30 is rotated to feed the board through the apparatus to a position in which the leading end is adjacent the trimming blade 32 and the end is trimmed square, whereupon the strips S are advanced to a position over the cross-bar 33 and under the pneumatic clamps 35 which are operated to clamp the strips S to the cross-bar 33. The central mandrel 53 is positioned between the flanges 51 and 52 and the advancing means is actuated to position the leading ends of the strips S adjacent the clamping strip 55 on the mandrel 53 and the ends of the strips S are clamped to the central mandrel 53 and the winding operation commences.

As the strips S run over the applicator roller 40, an appropriate quantity of adhesive is transferred to the corrugated medium of the board B and as the strips S are tightly wound by the winding reel 5, under the tension supplied by the tensioning roller 22, adjacent layers of the strips S are adhesively secured to each other. The mandrels $\mathbf{59}_3$ to $\mathbf{59}_{18}$ are advanced into the space between the parallel flanges 51 and 52 at the appropriate times in the winding cycle to thereby form the shaped openings in the pallet structure described above, and this is illustrated in FIGS. 9*a* to 9*g*. Near the end of the winding cycle, hot melt adhesive is applied by the hot melt applicator 42 to the top surface of the strips S which are thereby adhesively secured to prevent unwinding when the winding operation is complete.

After the winding operation has been completed, the mandrels $\mathbf{59}_3$ to $\mathbf{59}_{18}$ are withdrawn and the pallet structures P are pushed from the space between the flanges 51 and 52 by a pushing mechanism (not shown) and are carried by a roller conveyor 62 to a removal position.

A separate winding reel, similar to the winding reel 5, but having only a single elongate rectangular mandrel (not shown) is used to form the feet $F_1$, to $F_3$ of the pallet described above, and the feet $F_1$ to $F_3$ are subsequently adhesively secured in the manner shown to the pallet structure P. If desired, the feet be formed in some other way or from some other material, although the use of corrugated board is convenient for recycling purposes. The need to form feet may be avoided by forming the pallet structure from wider strips S of corrugated board and forming lifting fork slots or grooves in one face of the pallet structure. This method of forming fork openings is not preferred since the addition of legs of the type described above provides further strength to the finished pallet structure.

We claim:

1. A method of forming a lightweight pallet comprising the steps of continuously winding a strip of paper, cardboard or corrugated board around a central mandrel to define a central opening, introducing other shaped mandrels between the paper, cardboard or corrugated board already wound and the paper, cardboard or corrugated board being wound to create a multiplicity of shaped openings, winding an outer layer of said paper, cardboard or corrugated board to give the pallet its final shape, applying adhesive to at least one side of said paper, cardboard or corrugated board as it is wound around said central mandrel and said other shaped mandrels, and severing the paper, cardboard or corrugated board when the winding operation is complete.

2. The method of claim 1, comprising the step of slitting a wider strip of paper, cardboard or corrugated board into a multiplicity of narrower strips for forming a multiplicity of pallet structures.

3. The method of claims 1 or 2, wherein said corrugated board is single-face corrugated board and said adhesive is applied to a corrugated medium of said corrugated board.

4. The method of claim 1, further comprising the steps of supporting a roll of said paper, cardboard or corrugated board, tensioning said paper, cardboard or corrugated board as it leaves said roll, advancing said paper, cardboard or corrugated board from said roll to a forming reel, and attaching a free end of said paper, cardboard or corrugated board to said reel to enable the paper, cardboard or corrugated board to be wound onto the reel.

5. The method of claim 4, further comprising the steps of withdrawing said other shaped mandrels when the winding operation is complete, and severing said paper, cardboard or corrugated board when the winding operation is complete.

6. The method of claim 5, further comprising the step of applying quick setting adhesive to a upper face of said paper, cardboard or corrugated board near the end of the winding operation.

7. A method of forming a lightweight pallet comprising the steps of supporting a roll of said paper, cardboard or corrugated board, tensioning said paper, cardboard or corrugated board as it leaves said roll, advancing said paper, cardboard or corrugated board from said roll to a forming reel, applying adhesive to at least one side of said paper, cardboard or corrugated board, attaching the free end of said paper, cardboard or corrugated board to said reel to enable the paper, cardboard or corrugated board to be wound onto the reel, continuously winding said strip of paper, cardboard or corrugated board around a central mandrel to define a central opening, introducing other shaped mandrels between the paper, cardboard or corrugated board already wound and the paper, cardboard or corrugated board being wound to create a multiplicity of shaped openings, winding an outer layer of said paper, cardboard or corrugated board to give the pallet its final shape, withdrawing said other shaped mandrels when the winding operation is complete, and severing said paper, cardboard or corrugated board when the winding operation is complete.

* * * * *